US005314370A

United States Patent [19]

Flint

[11] Patent Number: 5,314,370

[45] Date of Patent: May 24, 1994

[54] PROCESS FOR PRODUCING A DOLL

[76] Inventor: Mary L. Flint, 217 Artillery Rd., Middlebury, Conn. 06762

[21] Appl. No.: 36,961

[22] Filed: Mar. 25, 1993

[51] Int. Cl.[5] ..... A63H 3/36

[52] U.S. Cl. ..... 446/391; 446/372; 156/61

[58] Field of Search ..... 446/391, 372, 97; 156/64, 61, 277, 240, 247

[56] References Cited

U.S. PATENT DOCUMENTS

| | | | |
|---|---|---|---|
| 4,773,953 | 9/1988 | Hare | 156/277 X |
| 4,929,213 | 5/1990 | Morgan | 446/97 |
| 4,993,987 | 2/1991 | Hull et al. | 446/391 X |
| 5,009,626 | 4/1991 | Katz | 446/391 |

FOREIGN PATENT DOCUMENTS

| | | | |
|---|---|---|---|
| 418730 | 3/1991 | European Pat. Off. | 446/391 |

*Primary Examiner*—Danton D. DeMille
*Attorney, Agent, or Firm*—Dallett Hoopes

[57] ABSTRACT

Doll making process includes steps of positioning the certain person in front of a video camera, adjusting the position of the person and the camera so that the face fills certain boundaries on a monitor screen, transferring the signal from the video camera to a color transfer printer and printing the resulting image on a wax layer supported on a substrate. The wax layer is pressed and heated against a layer of natural fabric to transfer the wax layer onto the layer of fabric. The fabric layer is secured, image outward, onto the facial area of the doll.

6 Claims, 1 Drawing Sheet

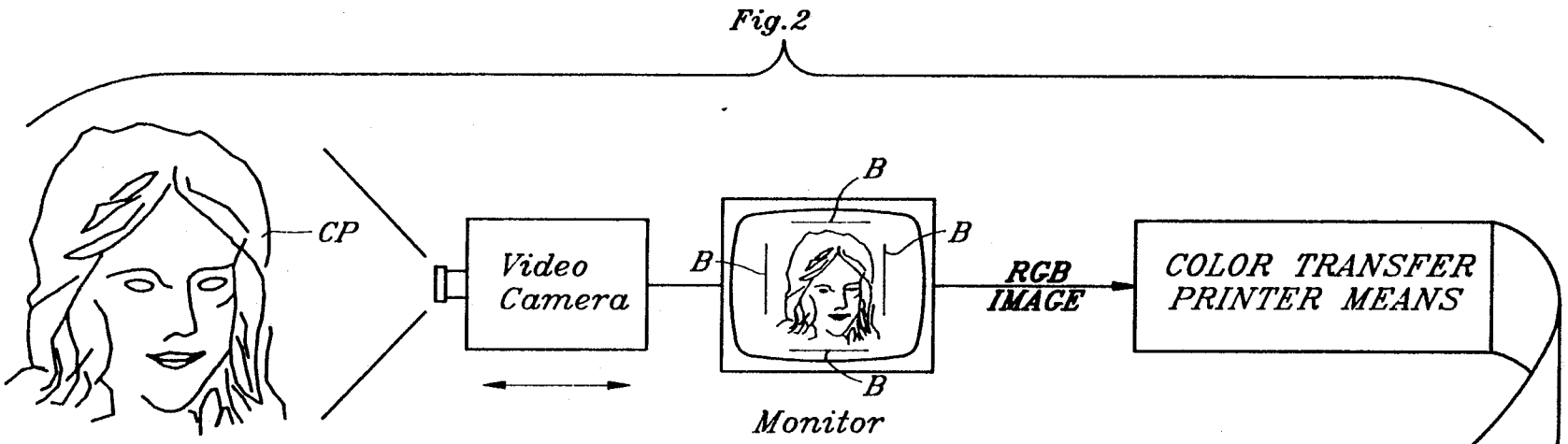
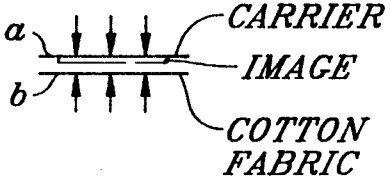
Fig.3
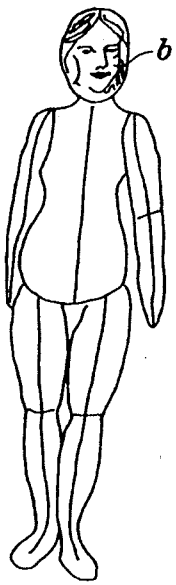
Fig.4
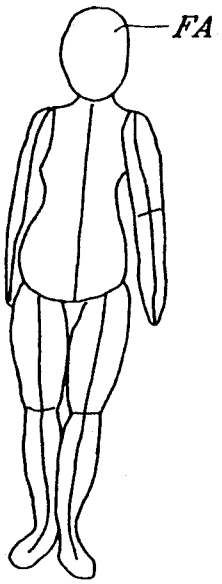
Fig.1

PROCESS FOR PRODUCING A DOLL

BACKGROUND OF THE INVENTION

1. Field of the Invention

This invention relates to a process for producing a doll having a facial similarity to a certain person. More specifically, this invention relates to a process for producing a doll having a face which is a wax transfer made by directing a video camera at the certain person and printing the image on a wax layer by color transfer printer means.

2. Description of Related Art including Information Disclosed under §§1.97 to 1.99

There are in the prior art a number of patents relating to manufacture of dolls having a facial appearance like a certain person. An example is the U.S. Pat. No. 4,993,987 which issued Feb. 19, 1991 to Hull et al and teaches the idea of making a doll by using a color photograph, scanning the photograph to produce components of the three basic colors, cutting a stencil for each of the colors and using an offset printer for each of the three colors to produce a paper having a coating of each color using heat cured inks. The printing paper is then held against the doll's face using a pressing iron at approximately 400° so that the photograph image is sublimated into the material.

The U.S. Pat. No. 2,199,049 to Greenberg which issued Apr. 30, 1940 and U.S. Pat. No. 5,141,466 which issued Aug. 25, 1992 to Catizone both show means for holding photographs or pictures in the facial area of a doll to make the doll appear like a certain person.

The old De Vall et al U.S. Pat. No. 933,448 which issued Oct. 14, 1906 placed photographic film in the facial area of a doll and then exposed it somehow so that the image of a certain person appeared on the film.

Finally, the Blair U.S. Pat. Nos. 4,648,188 issued Mar. 10, 1987 and 4,659,319 which issued Apr. 21, 1987 describe the idea of attaching a photograph to a pliable mass that will be the doll's head so that the photograph can be used as a guide to shaping the underlying mass to cause the mass, when the photograph is removed, to have the facial contours depicted in the photographs. One of the Blair patents also teaches the idea of making a sack with a printed image on the outside and filling the sack with a pliable mass and shaping the mass and sack.

SUMMARY OF THE INVENTION

The invention is a process for producing a doll having a face resembling a certain person. The invention includes the steps of positioning the certain person in front of a video camera, adjusting the position of the person and the camera so that the face fills certain boundaries on a monitor screen, transferring the signal from the video camera to a color transfer printer and printing the resulting image on a wax layer supported on a carrier substrate. The invention includes the further step of pressing the carrier with wax layer against a layer of fabric of natural fibers using heat and pressure to transfer the wax layer onto the layer of fabric, and securing the fabric layer onto the facial area of the doll.

BRIEF DESCRIPTION OF THE DRAWINGS

Further objects and features of the invention will be apparent from the following specification and a study of the accompanying drawings, all of which disclose a non-limiting embodiment of the invention. In the drawings:

FIG. 1 is a front plan view of a doll before the practice of the invention;

FIG. 2 is a flow diagram showing a part of the process of the invention;

FIG. 3 is a sectional view showing the transfer of the wax layer from its substrate onto the fabric in accordance with the invention; and FIG. 4 is a plan view similar to FIG. 1 but showing the head of the doll after the securing of the fabric to the facial area of the head.

DESCRIPTION OF THE PREFERRED EMBODIMENT

The invention as stated is a process for making a doll having a face resembling a certain person. In the process, a previously made doll—preferably a soft body doll—is provided having a three-dimensional body and having a head (FIG. 1) which has a three-dimensional facial area FA.

In the process which is preferably located in a high profile commercial area such as a shopping mall or toy store, a video camera (FIG. 2) is directed toward a certain person CP which is to be the object of the process. Alternatively the camera may be directed to the head on a photograph of the certain person.

As is customary, a signal from the video camera which bears RGB components, that is, components for red, green and blue, is displayed on a monitor screen. The screen shows fixed boundary lines or dots as at B, and the position of the camera or its lens and the certain person are adjusted so that the face on the monitor virtually fills the space defined by the boundary marks B. This is critical in order that the final image have the proper size so that it can suitably fill the facial area on the doll.

The frozen (that is, still) RGB image signal from the camera is captured and digitalized (such as by Kodak 6600), then conducted to a thermal wax color transfer printer (such as Seiko 4104). The image is printed by the thermal wax color printer on to the carrier which is a fabric transfer media.

In printing, the image may be reversed by the printer if desired or necessary. The size of the image appearing on the wax is appropriate for filling the facial area FA of the doll.

In the next step the fabric transfer media a containing the printed image is placed against a layer of fabric b (FIG. 3). At this point heat and pressure (arrows) are applied, the heat being about 350° F., to transfer the wax image onto the fabric. In order to receive the layer, the fabric must be of a predominately natural fiber, such as 100% cotton, and the pressure and heat must be applied long enough, about 12 or so seconds, for the image to clearly transfer and adhere itself onto the natural fiber fabric in a clear image.

Next, the fabric transfer media is removed from the fabric layer to reveal the transferred image. The excess fabric about the perimeter of the face is trimmed off. Finally, the fabric is applied image outward, preferably by cement, to the facial area of the doll (FIG. 4). An effective cold cement has been found to be a cement called "Aleene's Transfer It" made by a division of Artis, Inc. of Buellton, Calif. 93427.

The process may take only three or four minutes and the product is a doll having a face with a lifelike resemblance to the certain person CP with natural coloring and expression.

The equipment used in an installation for accomplishing the process of the invention is illustratively given herebelow for the purpose of enabling others to practice the invention. For the RGB video camera, a model number 360 Hitachi has been found to be suitable. The monitor may be a conventional Magnavox 13" video monitor and the boundary marks may be made directly on the screen using an opaque tape, for instance, or incorporated into the signal so as to appear on the screen in their proper place whenever the monitor is on. As noted, the image capture and digitalization can be made by a Kodak model 6600 and conducted to a thermal wax color transfer printer, Seiko model 4104. It should be understood that there are other units that are available which will work as well, the above being illustrative.

Preferably, the fabric chosen is 100% cotton, or at least predominately cotton for adequate adherence.

Obviously, the doll selected may be a variety of shapes. As an adjunct to the process the purchaser may be permitted to select from a wide variety of doll clothing, clothing which would be appropriate to the person whose face is depicted.

It should be understood that the invention is not limited to the embodiment shown but the invention is instead defined by the scope of the following claim language, expanded by an extension of the right to exclude as is appropriate under the doctrine of equivalents.

What is claimed is:

1. A process for producing a doll having a face resembling a certain person including the steps of:

a. providing a doll having a head and a three-dimensional facial area, b. posing a certain person or color photograph of the certain person in front of a color video camera, c. using a video monitor having a screen provided with lateral and up-and-down boundary markers, adjusting the position of the person or photograph and the camera so that the face of the certain person is where the sides and top and bottom of the face on the monitor screen generally line up with the respective boundary markers on the monitor screen to produce from the camera an output signal representing a still picture of the face of desired size, d. transferring the signal from the video camera to color transfer printer means to produce on a suitable of the face, e. juxtaposing the wax layer with the representation of the face against a layer of fabric of natural fiber, f. applying to the juxtaposed layers heat and pressure to transfer the wax layer including the representation of the face onto the layer of fabric, g. trimming the layer of fabric about the perimeter of the face, and h. securing with cement the layer of fabric with the wax representation of the face outward onto the facial area of the doll.

2. A process for producing a doll as claimed in claim 1 wherein the fabric is 100% cotton.

3. A process for producing a doll as claimed in claim 1 wherein the heat is a temperature of about 350° F.

4. A process for producing a doll as claimed in claim 1 wherein the substrate is paper.

5. A process for producing a doll as claimed in claim 1 wherein the color transfer printer means is a color transfer printer and a color transfer enlarger.

6. A process for producing a doll as claimed in claim 1 wherein the process is accomplished in less than four minutes.

* * * * *

UNITED STATES PATENT AND TRADEMARK OFFICE

CERTIFICATE OF CORRECTION

PATENT NO. : 5,314,370

DATED : May 24, 1994

INVENTOR(S) : Mary L. Flint

It is certified that error appears in the above-identified patent and that said Letters Patent is hereby corrected as shown below:

In the Claims:

Column 4, line 15, after "able", insert --substrate a wax layer carrying a color representation--

Signed and Sealed this

Twentieth Day of December, 1994

Attest:

Bruce Lehman

BRUCE LEHMAN

Attesting Officer

Commissioner of Patents and Trademarks